US007388207B1

(12) United States Patent
Zeng

(10) Patent No.: US 7,388,207 B1
(45) Date of Patent: Jun. 17, 2008

(54) SKEW SLIT COLLIMATOR AND METHOD OF USE THEREOF

(75) Inventor: Gengsheng Lawrence Zeng, Salt Lake City, UT (US)

(73) Assignee: University of Utah Research Foundation, Salt Lake City, UT (US)

( * ) Notice: Subject to any disclaimer, the term of this patent is extended or adjusted under 35 U.S.C. 154(b) by 128 days.

(21) Appl. No.: 11/391,599

(22) Filed: Mar. 28, 2006

(51) Int. Cl.
*G21K 1/02* (2006.01)

(52) U.S. Cl. ..... 250/363.1

(58) Field of Classification Search ..... 250/363.1
See application file for complete search history.

(56) References Cited

U.S. PATENT DOCUMENTS 4,404,591 A 9/1983 Bonar
4,506,374 A 3/1985 Flynn
5,055,687 A * 10/1991 Ichihara ..... 250/363.09
5,396,534 A * 3/1995 Thomas ..... 378/160
6,359,279 B1 3/2002 Gagnon et al.
6,552,349 B2 9/2002 Gagnon et al.
2004/0239941 A1 12/2004 Schramm et al.
2005/0111626 A1* 5/2005 Xu et al. ..... 378/147
2005/0152499 A1* 7/2005 Zhao et al. ..... 378/147
2006/0126793 A1* 6/2006 Li ..... 378/152

* cited by examiner

*Primary Examiner*—David P. Porta
*Assistant Examiner*—Mark R Gaworecki
(74) *Attorney, Agent, or Firm*—Law Offices of Manisha Chakrabarti

(57) ABSTRACT

A skew slit collimator for a gamma ray imaging device and a method of configuring the skew slit collimator for a gamma ray imaging device is disclosed. The gamma ray imaging device includes a detector having a generally planar detector surface. The detector surface is operable to be positioned adjacent a subject imaging region. The skew slit collimator includes a first collimator blade having a first slit and a second collimator blade having a second slit. The first collimator blade is disposed in front of and generally parallel to the detector surface. The second collimator blade is disposed between the first collimator blade and the detector surface. The second collimator is generally parallel to and spaced apart from the first collimator blade. The second collimator blade is oriented with respect to the first collimator blade such that the lengthwise orientation of the second slit is generally orthogonal to a lengthwise orientation of the first slit.

24 Claims, 5 Drawing Sheets

Fig. 8
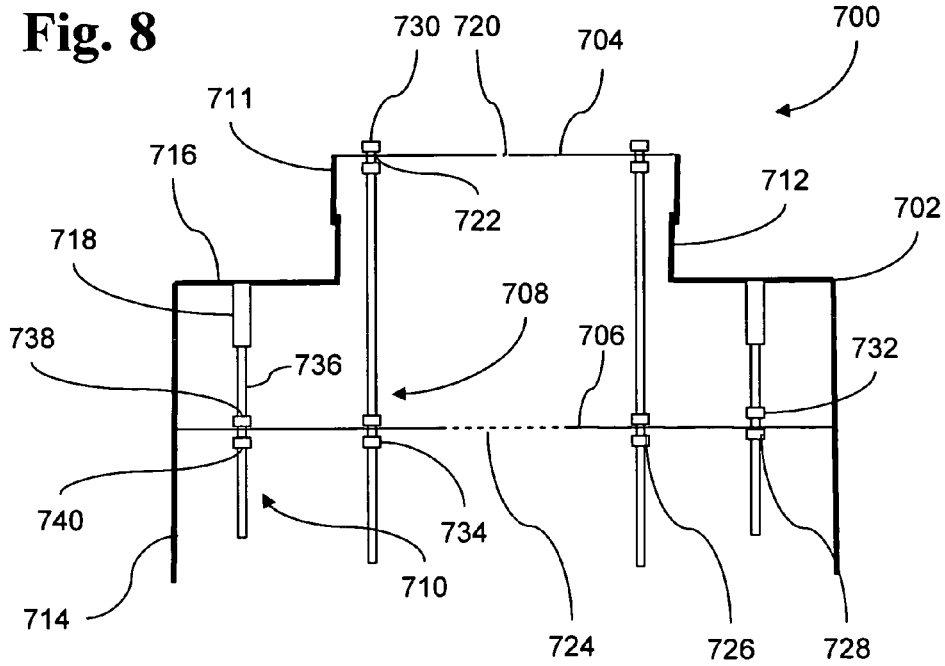
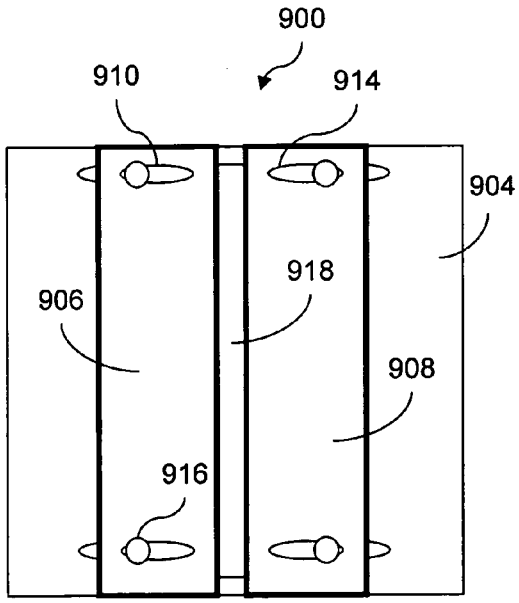
Fig. 9
Fig. 11
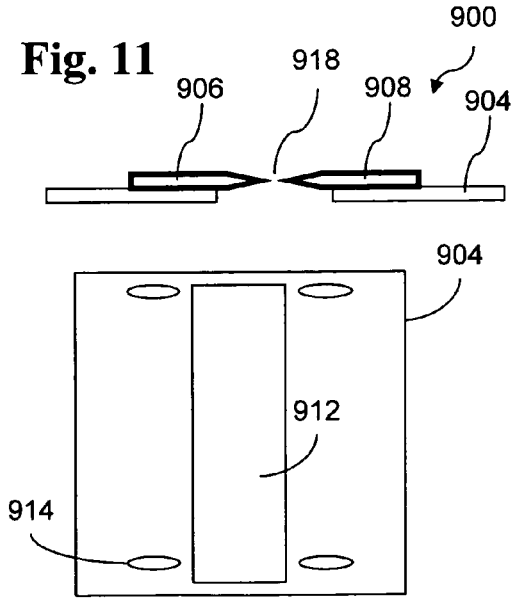
Fig. 10

SKEW SLIT COLLIMATOR AND METHOD OF USE THEREOF

GOVERNMENTAL INTERESTS

This invention was made with government support under grants number EB001489 and EB003298 awarded by National Institutes of Health. The United States government has certain rights to this invention.

FIELD OF THE INVENTION

The present invention relates generally to a gamma ray imaging device, and more particularly to a skew slit collimator for a gamma ray imaging device and a method of use thereof.

BACKGROUND OF THE INVENTION

The emergence of new animal models that mimic human disorders has enabled innovative, fundamental and therapeutic approaches to medical research. Mice, rats, and guinea pigs have become ubiquitous participants in most areas of molecular biology, toxicology, and drug discovery research. Well-characterized models have been developed to enable the study of a wide range of diseases and offer the possibility of studying the fundamental mechanisms of such diseases, as well as provide opportunities to test the effectiveness of potential drugs. As a result, there has been an increase in demand for effective imaging technologies, especially those directed to in vivo small animal imaging. Effective small animal imaging provides keen insights into human physiology and disease processes. For example, such information is particularly important in the area of gene therapy, where an imaging system can be used to assess the success of vector delivery and obtain accurate time curves of gene expression. Effective in vivo imaging technologies may also help researchers expedite pre-clinical drug development processes, potentially saving numerous years and thousands of dollars on drugs that may ultimately not prove to be efficacious and/or safe.

Single photon emission computed tomography (SPECT) and photon emission tomography (PET) are nuclear imaging procedures that can be used to perform in vivo small animal imaging. High-resolution SPECT systems are commonly used in tracer development and pre-clinical research where new radiopharmaceuticals have to be tested and evaluated in small-animal studies. The fundamental principle underlying nuclear imaging is the use of agents, which localize in specific organs or tissue on the basis of their biochemical or physiological properties. Typically one or more radiopharmaceuticals or radioisotopes are injected into the subject bloodstream. The injected radiopharmaceuticals are absorbed by and accumulate in the selectively targeted subject organ. The accumulated radiopharmaceuticals emit energy in the form of gamma rays or photons that illuminate the target organ. A nuclear imaging system, such as for example a SPECT imaging system, is used to create an image of the distribution of the accumulated radioactive pharmaceutical within the target organ within the subject.

Nuclear imaging is performed using a gamma ray imaging device that consists of a gamma ray detector and a collimator. One or more gamma ray imaging devices are typically placed adjacent to a surface of the subject to monitor and record the radiation emitted by the target organ. The gamma rays emitted by the target organ are collimated or sorted by the collimator and recorded by the gamma detector.

Each gamma ray detector typically includes a scintillation crystal which produces a flash or scintillation of light each time it is struck by radiation emanating from the radioactive dye in the subject. An array of photomultiplier tubes and associated circuitry produces an output signal which is indicative of the (x, y) position of each scintillation on the crystal. The one or more gamma ray imaging devices are typically are rotated or indexed around the subject to monitor the emitted radiation from a plurality of different angles to obtain multiple two dimensional images of the subject target organ. The collected two dimensional images are used to compute or reconstruct a three dimensional volumetric representation of the target organ.

The computed tomographic images reveal physiology and cellular metabolism. With the use of specific radiotracers, radio imaging techniques can provide various forms of metabolic information, such as for example, functional and oncological imaging, the evaluation of new radiopharmaceuticals for increased diagnostic efficacy, the evaluator or new receptor ligands, and reporter gene expression imaging.

When gamma ray imaging devices are used in small animal imaging, the detection sensitivity and the spatial resolution of a projected image of the subject target organ often depends upon the geometry of the collimation system. One prior art collimator, a parallel hole collimator, is routinely employed in small animal imaging, however the parallel hole collimation is typically not geometrically efficient for small animal imaging.

Another prior art collimator often used in small animal imaging is a single pinhole collimator. The single pinhole collimator provides generally high spatial resolution and reasonable sensitivity when the subject is placed in close proximity to the pinhole. A single pinhole collimator generates a cone beam imaging geometry. A large cone angle, as typically generated by a single pinhole collimator, generally provides relatively large image magnification, which in turn results in greater spatial resolution. However, a large cone-angle also causes a data insufficiency problem which translates into increased distortion and artifact severity in a reconstructed three dimensional image. The severity of artifact is generally proportional to the cone-angle of the single pinhole in the direction of the axis of rotation. Increasing the distance between the single pinhole collimator and the subject, thereby generating a smaller cone angle, may decrease the severity of artifacts. However, sensitivity is also decreased when the single pinhole collimator-to-subject distance is increased.

Another prior art collimator often employed when imaging small animals is a multiple pinhole collimator. The multiple pinhole collimator, having a plurality of pinholes, typically reduces cone-beam related artifact effects and increases detection sensitivity by tiling the detector with multiple cone-beam images. The multiple pinhole collimator is typically placed relatively farther away from the subject than a single pinhole collimator thereby generating smaller cone angles. The use of smaller cone angles typically mitigates data insufficiency problems and decreases the severity of artifacts. However, the use of smaller cone angles also results in reduced image magnification, which in turn results in decreased spatial resolution. The use of multiple pinholes allows a greater number of photons to pass through the multiple pinhole collimator thereby improving sensitivity. However, the number of pinholes that may be used is limited since the use of too many pinholes may result in the overlapping of projected images on the detector thereby reducing the quality of the tomographic information content in the projection data.

Thus what is needed is a collimator and method of configuring the collimator for use with a gamma ray imaging device to overcome one or more of the challenges and/or obstacles described above.

SUMMARY OF THE INVENTION

One aspect of the invention provides a skew slit collimator for a gamma ray imaging device where the gamma ray imaging device includes a detector having a generally planar detector surface that is operable to be positioned adjacent a subject imaging region. The skew slit collimator includes a first collimator blade having a first slit and a second collimator blade having a second slit. The first collimator blade is disposed in front of and generally parallel to the detector surface. The second collimator blade is disposed between the first collimator blade and the detector surface such that the second collimator is generally parallel to and spaced apart from the first collimator blade. The lengthwise orientation of the second slit is generally orthogonal to the lengthwise orientation of the first slit.

Another aspect of the invention provides a method of configuring a skew slit collimator for a gamma ray imaging device including a detector having a generally planar detector surface where the detector surface is operable to be positioned adjacent a subject imaging region. A first collimator blade having a first slit is positioned in front of and generally parallel to the detector surface. A second collimator blade having a second slit is positioned generally parallel to and spaced apart from the first collimator blade. The second collimator blade is oriented with respect to the first collimator blade such that the lengthwise orientation of the second slit is generally orthogonal to a lengthwise orientation of the first slit.

BRIEF DESCRIPTION OF THE DRAWINGS

The present invention is illustrated by way of example and not limited in scope to the accompanying figures, in which like reference numerals indicate similar elements, and in which:

FIG. 8 is side cross-sectional view of the skew slit collimator of FIG. 7;

FIG. 9 is a top view of a collimator blade having a slit width adjustment mechanism in accordance with the principles of the present invention;

FIG. 10 is a top view of a base collimator blade of the collimator blade of FIG. 9; and FIG. 11 is a side view or the collimator blade of FIG. 9.

DETAILED DESCRIPTION OF THE PREFERRED EMBODIMENTS

Figure 1:
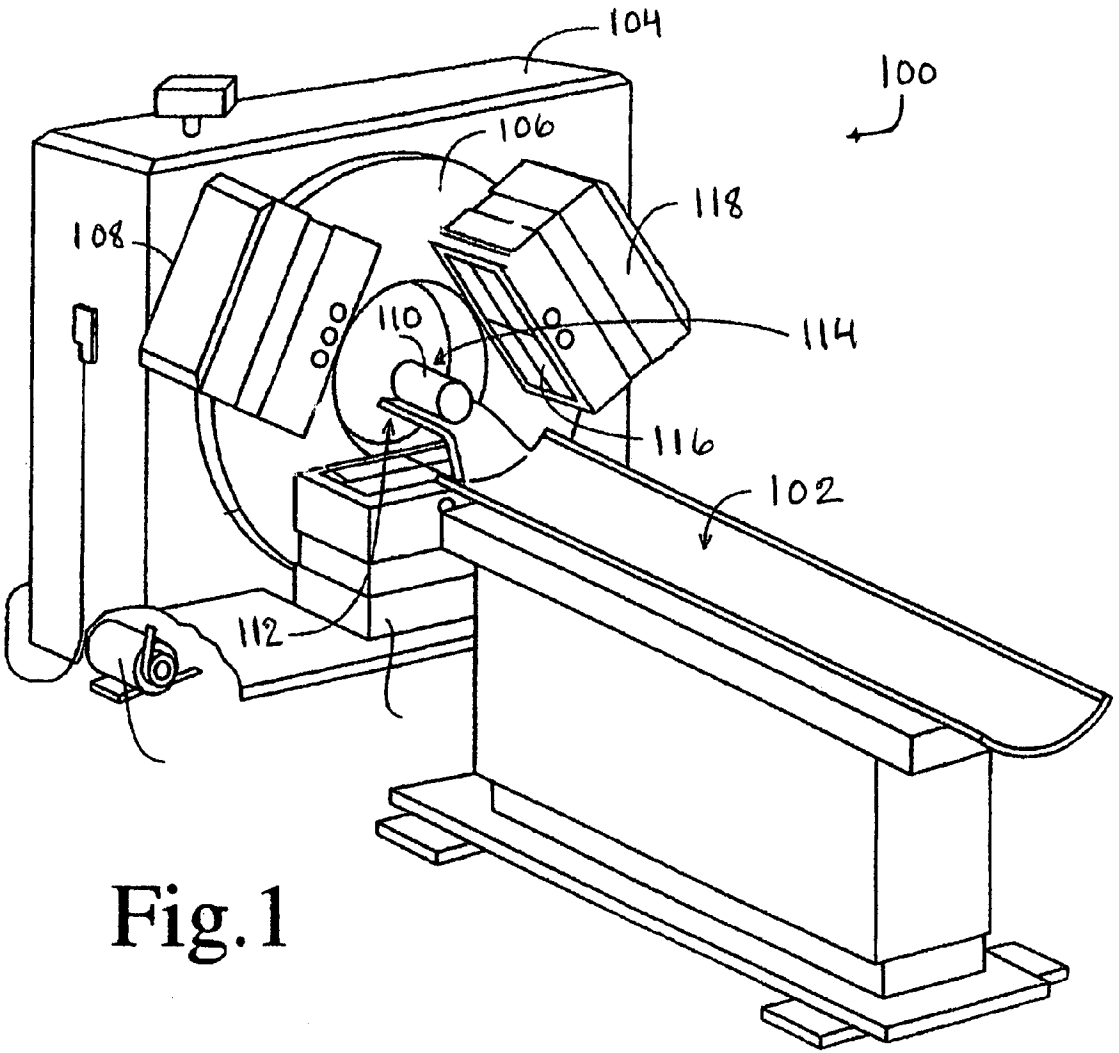
FIG. 1 is a perspective view of one embodiment of a nuclear imaging assembly in accordance with the principles of the present invention.

Referring to FIG. 1 a perspective view of one embodiment of a nuclear imaging assembly 100 in accordance with the principles of the present invention is shown. The nuclear imaging assembly 100 generally includes a subject support structure 102, a base gantry 104, a rotatable gantry 106, and one or more gamma ray imaging devices 108. A subject 110, such as for example a small animal, is typically injected with one or more radiopharmaceuticals or radioisotopes. The injected radiopharmaceuticals are absorbed by and localize within a target organ in the subject 110. The accumulated radiopharmaceuticals emit energy in the form of gamma rays or photons that illuminate the target organ. The nuclear imaging assembly 100 creates images of the distribution of the accumulated radioactive pharmaceuticals within the subject target organ.

The subject support structure 102 supports the subject 110 to be imaged. Examples of subjects 110 include, but are not limited to, small animals, portions of animals, and phantoms. The rotatable gantry 106 is mounted on the base gantry 104 and defines a subject receiving aperture 112 with a subject imaging region 114 within the subject receiving aperture 112. One or more gamma ray imaging devices 108 are adjustably mounted to the rotatable gantry 106. In one embodiment, the gamma ray imaging devices 108 are positioned at regular intervals around the subject imaging region 114. For example, a total of three gamma ray imaging devices 108 may be positioned on the rotatable gantry 106 at 120° intervals around the subject imaging region 114. In another embodiment, the gamma ray imaging devices 108 may be circumferentially adjustable to selectively vary their relative spacing with respect to each other on the rotatable gantry 106. In one embodiment, separate translation devices such as motors and drive assemblies (not shown) independently translate the gamma ray imaging devices 108 laterally in directions tangential to the subject imaging region 114 along linear tracks or other appropriate guide structures. In another embodiment, the gamma ray imaging devices 108 are also independently movable in a radial direction with respect to the subject imaging region 114. In yet another embodiment, the gamma ray imaging devices 108 can be selectively canted or tilted with respect to the radial lines from the center of the subject imaging region 114. A motor and drive system (not shown) is employed to control the movement of the gamma ray imaging devices 108. In one embodiment, each gamma ray imaging device 108 can be positioned and controlled individually. In another embodiment, the gamma ray imaging devices 108 can be positioned and controlled together as a unit.

In one embodiment, the base gantry 104 can be advanced towards and/or retracted from the subject support structure 102 so as to appropriately position the subject 110 within the subject imaging region 114 to obtain desired images of the target organ. In another embodiment, the subject support structure 102 can be advanced towards and/or retracted from the base gantry 104 to achieve the desired positioning of the subject 110 within the subject imaging region 114. In yet another embodiment, the subject support structure 102 can be raised or lowered to appropriately position the subject 110 within the subject imaging region 114.

Each of the one or more gamma ray imaging devices 108 includes a skew slit collimator 116 and a detector 118. Each detector 118 typically includes a scintillation crystal which produces a flash or scintillation of light each time it is struck by radiation emanating from the radioactive dye in the subject 110. An array of photomultiplier tubes and associated circuitry produces an output signal which is indicative of the (x, y) position of each scintillation on the crystal.

In operation, the subject 110 is placed on the subject support structure 102 and the subject support structure 102 is appropriately positioned within the subject receiving aperture 112 such that the target organ is positioned within the subject imaging region 114. The one or more gamma ray imaging devices 108 are appropriately positioned with respect to the subject target organ to be imaged. The one or more gamma ray detectors 108 are rotated or indexed in a generally circular orbit about the subject imaging region 114. The direction of the rotation of the gamma ray imaging devices 108 defines the axis of rotation 122. The one or more gamma ray imaging devices 108 detect the radiation emitted by the target organ from a plurality of different directions and capture multiple two dimensional images, where each image provides a different angular view of the target organ. The collected two dimensional images are used to compute or reconstruct three dimensional volumetric representations of the target organ.

In another embodiment of the invention, one or more gamma ray imaging devices 108 are mounted onto a base gantry. The subject support structure includes a rotatable subject support portion. The one or more gamma ray imaging devices 108 are maintained in stationary positions with respect to the subject imaging region. In operation, the subject is appropriately positioned on the rotatable subject support portion and the rotatable subject support portion is appropriately positioned within the subject imaging region. The rotatable subject support portion is rotated about an axis of rotation 122, where the axis of rotation 122 is generally parallel to the planar faces of the one or more gamma ray imaging devices 108. The one or more gamma ray imaging devices 108 detect the radiation emitted by the target organ from a plurality of different directions and capture multiple two dimensional images, where each image provides a different angular view of the target organ. The collected two dimensional images are used to compute or reconstruct three dimensional volumetric representations of the target organ.

Figure 2:
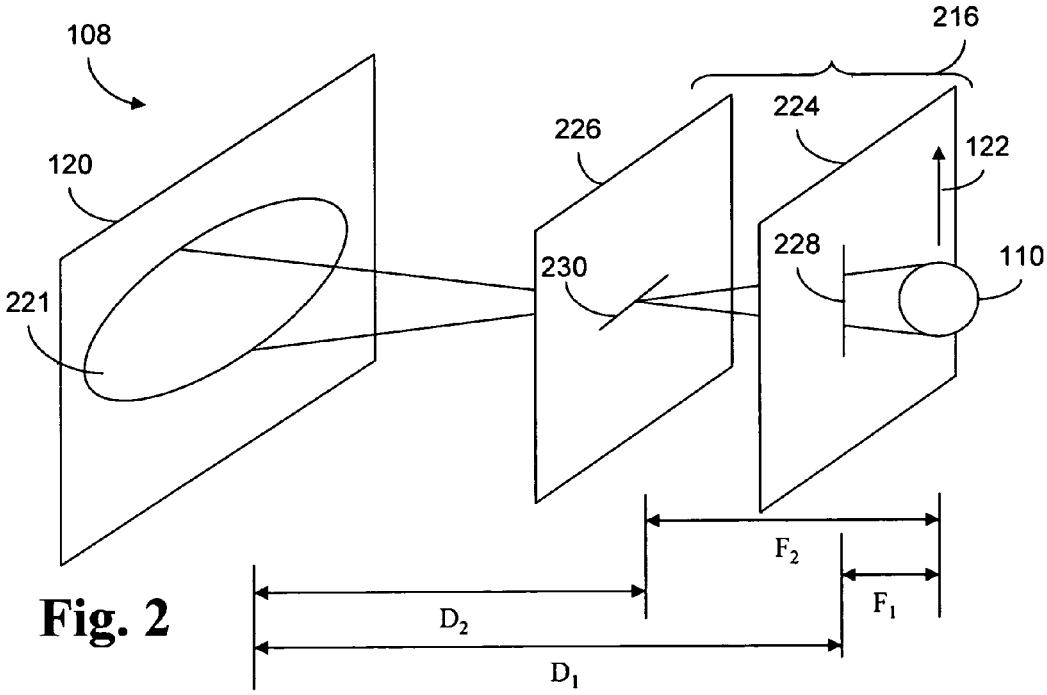
FIG. 2 is a schematic representation of a gamma ray imaging device equipped with one embodiment of a skew slit collimator positioned adjacent a subject in accordance with the principles of the present invention.

Referring to FIG. 2, a schematic representation of a gamma ray imaging device 108 equipped with one embodiment of a skew slit collimator 216 positioned adjacent a subject 110 in accordance with the principles of the present invention is shown. The gamma ray imaging device 108 generally includes a detector surface 120 of a detector 118, and a skew slit collimator 216. The gamma ray imaging device 108 is positioned with the skew slit collimator 216 adjacent the subject 110. An inverted and magnified image 221 of the subject 110 is projected onto the detector surface 120.

In one embodiment, the gamma ray imaging device 108 is rotated in a generally circular orbit about the subject imaging region 114 with the skew slit collimator 216 facing the subject 110. The axis of rotation 122 is defined by the direction that the gamma imaging device 108 is rotated about the subject imaging region 114. In another embodiment, the gamma ray imaging device 108 is maintained in a stationary position and the subject 110 is positioned on a rotatable subject support portion. The rotatable subject support portion is rotated thereby rotating the subject 110 with respect to the gamma ray imaging device 108. In which case, the axis of rotation 122 is defined by the direction of rotation of the rotatable subject support portion.

The skew slit collimator 216 includes a first collimator blade 224 and a second collimator blade 226. The first collimator blade 224 is positioned generally parallel to the detector surface 120 and adjacent the subject 110 positioned within the subject imaging region 114. More specifically, the first collimator blade 224 is positioned at a distance of $D_1$ from the detector surface 120 and at distance of $F_1$ from the axis of rotation 122. $F_1$ is the focal length associated with the first collimator blade 224. The distance $F_1$ is typically selected to be slightly larger than the maximum radius of the subject 110 that the user wishes to image. For example, for a phantom or subject having a maximum radius of approximately 1.5 cm, an $F_1$ distance of approximately 1.8 cm may be selected by the user. However, it should be noted that alternative distances for $F_1$ that are much greater than or smaller than the maximum radius of a subject 110 may be used without departing from the spirit of the invention.

The first collimator blade 224 includes a generally centered vertical slit 228. The first collimator blade 224 is oriented with respect to the subject imaging region 114 such that the lengthwise orientation of the vertical slit 228 is generally parallel to the axis of rotation 122. The length of the vertical slit 228 is selected to be greater than the maximum diameter of the subject 110. For example, if the maximum diameter of a particular subject 110 happens to be 5 cm, a vertical slit 228 having a length of greater than 5 cm is selected. However, it should be noted that the use of first collimator blades 224 having vertical slits 228 that is less than the maximum diameter of the subject 110 are also considered to be within the scope of the invention. The width $d_1$ of the vertical slit 228 is typically selected based on desired transaxial spatial resolution $R^H$. The relationship between the vertical slit width $d_1$ and transaxial spatial resolution $R^H$ will be discussed in greater detail below.

The second collimator blade 226 is positioned generally parallel to the detector surface 120 and between the first collimator blade 224 and the detector surface 120. More specifically, the second collimator blade 226 is positioned at a distance of $D_2$ from the detector surface 120 and at distance of $F_2$ from the axis of rotation 122. $F_2$ is the focal length associated with the second collimator blade 226. The second collimator blade 226 is spaced apart from the first collimator blade 224 such that the value of $F_2$ is greater than the value of $F_1$. When the value of $F_2$ is selected to be greater than the value of $F_1$, the cone-beam data related insufficiency artifacts and distortions are primarily a function of the value of $F_2$.

The second collimator blade 226 includes a generally centered horizontal slit 230. The second collimator blade 226 is oriented with respect to the first collimator blade 224 such that the lengthwise orientation of the horizontal slit 230 is generally orthogonal to the lengthwise orientation of the vertical slit 228. In other words, the lengthwise orientation of the horizontal slit 230 is generally orthogonal to the axis of rotation 122. In one embodiment, the length of the horizontal slit 230 is selected to be approximately the length of the detector surface 120. It should be noted however, that alternative horizontal slit lengths that are less than or greater than the length of the detector surface 120 are also considered to be within the scope of the invention. The selection of the horizontal slit width $d_2$ is typically based on desired axial spatial resolution $R^V$. The relationship between the horizontal slit width $d_2$ and axial spatial resolution $R^V$ will be discussed in greater detail below.

The amplification or magnification of the projected image 221 is typically evaluated in terms of a transaxial amplification factor in the horizontal or transaxial direction and an axial amplification factor in the vertical or axial direction. The horizontal or transaxial direction is the direction that is orthogonal to the axis of rotation 122. The vertical or axial direction is the direction that is parallel to the axis of rotation 122. The skew slit collimator 216 provides the flexibility of altering the amplification factor of the projected image 221 independently in the axial and the transaxial directions.

The position of the first collimator blade 224 having the vertical slit 228 governs amplification of the projected image 221 in the transaxial direction. The transaxial amplification factor is the ratio of the value of the distance $D_1$, the distance from the vertical slit 228 to the detector surface 120, to the value of the distance $F_1$, the distance from the vertical slit 228 to the axis of rotation 122, as represented by the equation below:

$$\text{Transaxial Amplification Factor}=D_1/F_1$$

As can be seen, the value of the distance $F_1$ controls image amplification in the transaxial direction. The lower the value of $F_1$ compared to the value of $D_1$, the greater the resultant transaxial amplification factor. The placement of the first collimator blade 224 in close proximity to the subject 110 results in a relatively small value for $F_1$ and results in the generation of a relatively large cone angle. Large cone angles typically provide relatively large image amplification. A large transaxial amplification factor is typically not a concern with respect to image artifacts as transaxial amplification does not cause the type of data insufficiency problems that typically result in distortion and artifacts in a reconstructed three dimensional image. This enables the user to select the shortest possible distance $F_1$ to achieve the greatest possible transaxial amplification factor. For example, the first collimator blade 224 may be positioned very close to the subject 110 such that the first collimator blade 224 is almost in physical contact with the subject 110.

The position of the second collimator blade 226 having the horizontal slit 230 governs amplification of the projected image 221 in the axial direction. The axial amplification factor is the ratio of the value of the distance $D_2$, the distance from the horizontal slit 230 to the detector surface 120, to the value of the distance $F_2$, the distance from the horizontal slit 230 to the axis of rotation 122, as represented by the equation below:

$$\text{Axial Amplification Factor}=D_2/F_2$$

The severity of artifact is generally proportional to the cone angle size in the axial direction. As a result, while a large cone angle typically provides relatively large image amplification, a large axial amplification factor also causes the type of data insufficiency problems which result in distortion and artifacts in a reconstructed three dimensional image. Therefore, the horizontal slit 230 is strategically positioned at $F_2$ to generate a relatively small cone angle. In one embodiment, the distance $F_2$ is selected such that the value of the associated axial amplification factor is typically maintained at or below approximately two. However, it should be noted that the selection of alternative values for the distance $F_2$ that generate axial amplification factors that are greater than two are also considered to be within the scope of the invention.

The spatial resolution of the projected image 221 is typically evaluated in terms of a transaxial spatial resolution $R^H$ and an axial spatial resolution $R^V$. Typically a skew slit collimator 216 having a vertical slit 228 and a horizontal slit 230 oriented as illustrated in FIG. 2, produces an image having relatively better transaxial spatial resolution $R^H$ than axial spatial resolution $R^V$.

The transaxial spatial resolution $R^H$ can be determined using the following equation:

$$R^H = \frac{[(D_1 + F_1)^2 d_1^2 + F_1^2 r^2]^{1/2}}{D_1}$$

where $D_1$ is the distance between the first collimator blade 224 and the dectector surface 120;

$F_1$ is the distance between the first collimator blade 224 and axis of rotation 122;

$d_1$ is the width of the vertical slit 228; and r is the intrinsic resolution of the detector surface 120.

Selecting a relatively small value for $F_1$, i.e. placing the first collimator blade 224 in close proximity to the subject 110, generates relatively superior transaxial spatial resolution $R^H$. Also, as can be seen from the equation above, the selection of the value of the vertical slit width $d_1$ also affects the transaxial spatial resolution $R^H$.

The axial spatial resolution $R^V$ can be determined using the following equation:

$$R^V = \frac{[(D_2 + F_2)^2 d_2^2 + F_2^2 r^2]^{1/2}}{D_2}$$

where, $D_2$ is the distance between the second collimator blade 226 and the detector surface 120;

$F_2$ is the distance between the second collimator blade 226 and axis of rotation 122;

$d_2$ is the width of the horizontal slit 230; and r is the intrinsic resolution of the detector surface 120.

While selecting a small value for the distance $F_2$, generates relatively better axial spatial resolution $R^V$, the use of a shorter $F_2$ also generates a large cone angle, which in turn provides a large axial amplification factor. As discussed above, a large axial amplification factor is undesirable because a large axial amplification factor causes the type of data insufficiency problems which result in distortion and artifacts in a reconstructed three dimensional image. Thus the selection of an appropriate $F_2$ involves the user balancing the interests of minimizing image distortion and artifacts versus maximizing the quality of axial amplification and axial spatial resolution $R^V$. Also, as can be seen from the equation above, the selection of the value of the horizontal slit width $d_2$ also affects the axial spatial resolution $R^V$.

An example of a skew slit collimator 216 configuration that seeks to balance the qualities of transaxial image amplification, axial image amplification, transaxial spatial resolution $R^H$, axial spatial resolution $R^V$, and distortion and artifact control for imaging a subject 110 that is approximately 2 cm to approximately 5 cm in diameter and approximately 5 cm to approximately 10 cm in length is described below. It should be noted that the values for the skew slit collimator 216 configuration parameters defined below have been selected for illustrative purposes only. The use of alternative skew slit collimator configuration parameter values is also considered to be within the scope and spirit of the invention.

| |
|---|
| $D_1$ = 260 mm |
| $D_2$ = 180 mm |
| $F_1$ = 20 mm |
| $F_2$ = 100 mm |
| $d_1$ = 0.8 mm |
| $d_2$ = 0.8 mm |
| r = 2.5 mm |

The values for the transaxial and axial amplification as well as the transaxial and axial spatial resolution obtained using the equations described above and are as follows:

| |
|---|
| Transaxial amplification factor = 13 |
| Axial amplification factor = 1.8 |
| Transaxial spatial resolution $R^H$ = 0.88 |
| Axial spatial resolution $R^V$ = 1.86 |

As can be seen, selecting a value of $F_2$ that is greater than a value of $F_1$ generates a transaxial amplification factor that is relatively greater than the axial amplification factor. Furthermore, when $F_2$ is greater than $F_1$, the cone beam data insufficiency artifacts and distortions are only affected by $F_2$. Therefore, the value of $F_1$ can be selected to achieve greater detection sensitivity and greater image amplification in the transaxial direction. Also, in this example, the selected vertical slit width $d_1$ is equal to the selected horizontal slit width $d_2$. If it is desirable to generate an image with a more isotropic spatial resolution, selecting a horizontal slit width $d_2$ that is smaller than the vertical slit width $d_1$ will generate an image where the transaxial spatial resolution is comparable to the axial resolution.

Figure 3:
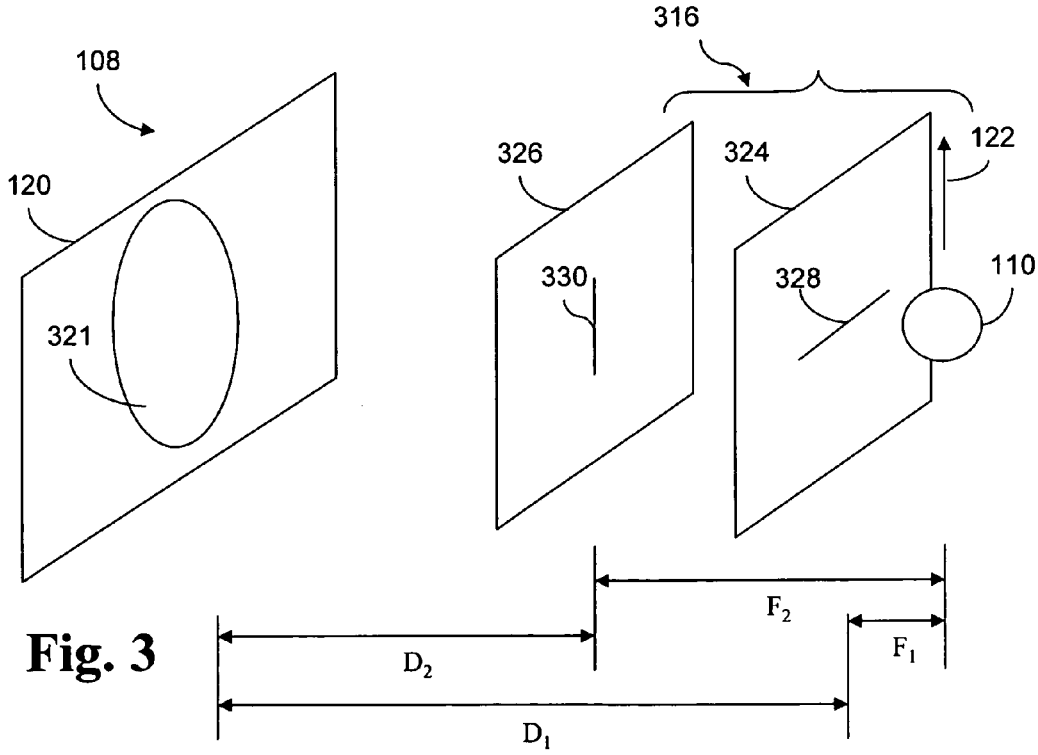
FIG. 3 is a schematic representation of a gamma ray imaging device equipped with another embodiment of a skew slit collimator positioned adjacent a subject in accordance with the principles of the present invention.

Referring to FIG. 3, a schematic representation of a gamma ray imaging device 108 equipped with another embodiment of a skew slit collimator 316 positioned adjacent a subject 110 in accordance with the principles of the present invention is shown. The gamma ray imaging device 108 generally includes a detector surface 120 of a detector 118, and a skew slit collimator 316. The gamma ray imaging device 108 is positioned such that the skew slit collimator 316 is adjacent the subject 110. An inverted and magnified image 321 of the subject 110 is projected onto the detector surface 120.

The skew slit collimator 316 includes a first collimator blade 324 and a second collimator blade 326. The first collimator blade 324 is positioned generally parallel to the detector surface 120 and in close proximity to the subject 110 within the subject imaging region 114. More specifically, the first collimator blade 324 is positioned at a distance of $D_1$ from the detector surface 120 and at distance of $F_1$ from the axis of rotation 122. $F_1$ is the focal length associated with the first collimator blade 324.

The first collimator blade 324 includes a generally centered horizontal slit 328. The first collimator blade 324 is oriented with respect to the subject imaging region 114 such that the lengthwise orientation of the horizontal slit 328 is generally orthogonal to the axis of rotation 122. The length of the horizontal slit 328 is selected to be greater than the maximum width of the subject 110 to be imaged. The horizontal slit width $d_1$ is typically selected based on desired axial spatial resolution $R^V$. The axial spatial resolution $R^V$ can be determined using the following equation:

$$R^V = \frac{[(D_1 + F_1)^2 d_1^2 + F_1^2 r^2]^{1/2}}{D_1}$$

where $D_1$ is the distance between the first collimator blade 324 and the detector surface 120;

$F_1$ is the distance between the first collimator blade 324 and the axis rotation 122;

$d_1$ is the width of the horizontal slit 328; and r is the intrinsic resolution of the detector surface 120.

The second collimator blade 326 is positioned generally parallel to the detector surface 120 and between the first collimator blade 324 and the detector surface 120. More specifically, the second collimator blade 326 is positioned at a distance of $D_2$ from the detector surface 120 and at distance of $F_2$ from the axis of rotation 122. $F_2$ is the focal length associated with the second collimator blade 326. The second collimator blade 326 is spaced apart from the first collimator blade 324 such that the value of $F_2$ is greater than the value of $F_1$.

The second collimator blade 326 includes a generally centered vertical slit 330. The second collimator blade 326 is oriented with respect to the first collimator blade 324 such that the lengthwise orientation of the vertical slit 330 is generally orthogonal to the lengthwise orientation of the horizontal slit 328. In other words, the lengthwise orientation of the vertical slit 330 is generally parallel to the axis of rotation 122. In one embodiment, the length of the vertical slit 330 is selected to be approximately the length of the detector surface 120. It should be noted however, that alternative vertical slit lengths that are less than or greater than the length of the detector surface 120 are also considered to be within the scope of the invention. The selection of the vertical slit width $d_2$ is typically based on desired transaxial spatial resolution $R^H$. The transaxial spatial resolution $R^H$ can be determined using the following equation:

$$R^H = \frac{[(D_2 + F_2)^2 d_2^2 + F_2^2 r^2]^{1/2}}{D_2}$$

where, $D_2$ is the distance between the second collimator blade 326 and the detector surface 120;

$F_2$ is the distance between the second collimator blade 326 and the axis of rotation 122;

$d_2$ is the width of the vertical slit 330; and r is the intrinsic resolution of the detector surface 120.

The placement of the first collimator blade 324 having the horizontal slit 328 adjacent the subject 110 and the second collimator blade 326 having a vertical slit 330 between the first collimator blade 324 and the detector surface 120 provides poorer spatial resolution in the transaxial direction than in the axial direction. This "rotated" skew slit collimator 316 configuration may be used in applications where a relatively small detector surface 120 is used to image a relatively large or relatively "fat" subject 110. In such a case, it is desirable to select a relatively low transaxial amplification factor to avoid truncation of the projected image 321 on the detector surface 120. The previously provided amplification factor equations for the skew slit collimator configuration illustrated in FIG. 2, are applicable to the skew slit collimator configuration illustrated in FIG. 3.

Figure 4:
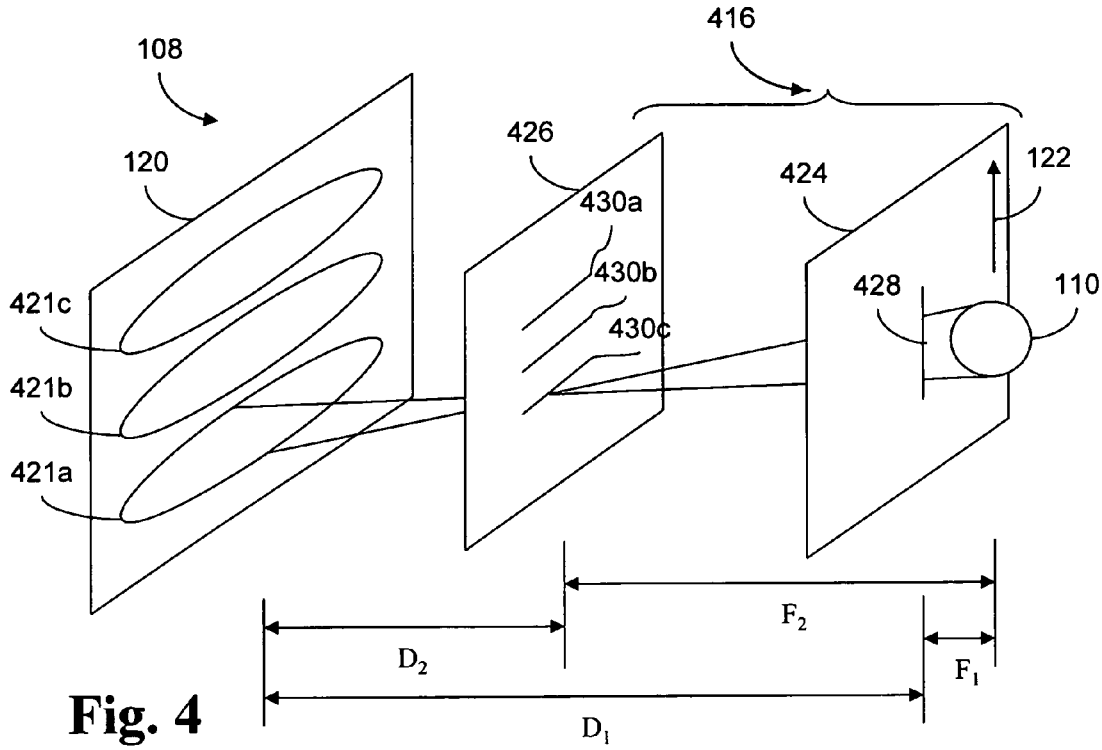
FIG. 4 is a schematic representation of a gamma ray imaging device equipped with yet another embodiment of a skew slit collimator positioned adjacent a subject in accordance with the principles of the present invention.

Referring to FIG. 4 a schematic representation of a gamma ray imaging device 108 equipped with yet another embodiment of a skew slit collimator 416 positioned adjacent a subject 110 in accordance with the principles of the present invention is shown. The gamma ray imaging device 108 generally includes a detector surface 120 of a detector 118, and a skew slit collimator 416. The gamma ray imaging device 108 is positioned with the skew slit collimator 416 adjacent the subject 110. Inverted and magnified images 421*a*, 421*b*, 421*c*, of the subject 110 are projected onto the detector surface 120.

The skew slit collimator 416 includes a first collimator blade 424 and a second collimator blade 426. The first collimator blade 424 is positioned generally parallel to the detector surface 120 and adjacent the subject 110 positioned within the subject imaging region 114. More specifically, the first collimator blade 424 is positioned at a distance of $D_1$ from the detector surface 120 and at distance of $F_1$ from the axis of rotation 122. $F_1$ is the focal length associated with the first collimator blade 424. The distance $F_1$ is typically selected to be slightly larger than the maximum radius of the subject 110 that the user wishes to image. However, it should be noted that alternative distances for $F_1$ that are much greater than or smaller than the maximum radius of a subject 110 may be used without departing from the spirit of the invention.

The first collimator blade 424 includes a generally centered vertical slit 428. The first collimator blade 424 is oriented with respect to the subject imaging region 114 such that the lengthwise orientation of the vertical slit 428 is generally parallel to the axis of rotation 122. The length of the vertical slit 428 is selected to be greater than the maximum diameter of the subject 110 that the user wishes to image. However, it should be noted that the use of first collimator blades 424 having a vertical slit 428 that is less than the maximum diameter of the subject 110 are also considered to be within the scope of the invention.

The second collimator blade 426 is positioned generally parallel to the detector surface 120 and between the first collimator blade 424 and the detector surface 120. More specifically, the second collimator blade 426 is positioned at a distance of $D_2$ from the detector surface 120 and at distance of $F_2$ from the axis of rotation 122. $F_2$ is the focal length associated with the second collimator blade 426. The second collimator blade 426 is spaced apart from the first collimator blade 424 such that the value of $F_2$ is greater than the value of $F_1$.

The second collimator blade 426 includes three horizontal slits 430*a*, 430*b*, 430*c*. The second collimator blade 426 is oriented with respect to the first collimator blade 424 such that the lengthwise orientation of the three horizontal slits 430*a*, 430*b*, 430*c*, are generally orthogonal to the lengthwise orientation of the vertical slit 428. In other words, the lengthwise orientation of the three horizontal slits 430*a*, 430*b*, 430*c* are generally orthogonal to the axis of rotation 122. Adjacent horizontal slits 430*a*, 430*b*, 430*c* are spaced approximately 100 mm apart with respect to each other. While the second collimator blade 426 is described as having three horizontal slits, it should be noted that a second collimator blade having two or more horizontal slits is considered to be within the scope of the invention. Furthermore, while adjacent horizontal slits are described as being spaced 100 mm apart with respect to each other, adjacent horizontal slits having spacing that is less than or greater than 100 mm is also considered to be within the scope of the invention.

The previously provided amplification factor equations for the skew slit collimator configuration illustrated in FIG. 2, are applicable to the skew slit collimator configuration illustrated in FIG. 4. The skew slit collimator 416 provides the flexibility of altering the amplification factor in the axial and transaxial directions independently. The position of the first collimator blade 424 having the vertical slit 428 governs the transaxial magnification of the projected images 421*a*, 421*b*, 421*c*. The smaller the distance $F_1$, the distance between the first collimator blade 424 and the subject 110, the greater the resulting transaxial magnification. A large transaxial magnification is typically not a concern with respect to image artifacts as transaxial amplification typically does not cause the type of data insufficiency problems that result in distortion and artifacts in a reconstructed three dimensional image. Therefore, the first collimator blade 424 can be place in close proximity to, even almost touching, the subject 110 in order to achieve relatively superior transaxial magnification.

The position of the second collimator blade 426 having the horizontal slits 430*a*, 430*b*, 430*c*, governs the axial amplification of the projected images 421*a*, 421*b*, 421*c*. The second collimator blade 426 is strategically positioned at a distance $F_2$ from the subject 110 to generate relatively small cone angles. While large cone angles provide greater image amplification, large axial amplification also causes the type of data insufficiency problems which result in distortion and artifact in a reconstructed three dimensional image. In one embodiment, the distance $F_2$ is selected such that the value of the associated axial amplification factor is typically maintained at or below approximately two. However, it should be noted that the selection of alternative values for the distance $F_2$ that generate axial amplification factors that are greater than two are also considered to be within the scope of the invention.

The use of a relatively large transaxial magnification translates into relatively superior transaxial spatial resolution $R^H$. Using a second collimator blade 426 having multiple horizontal slits 430*a*, 430*b*, 430*c*, produces multiple projected images 421*a*, 421*b*, 421*c*, of the subject 110 upon the detector surface 120. The multiple simultaneously projected images 421*a*, 421*b*, 421*c*, are not identical copies of each other, because each projected image 421*a*, 421*b*, 421*c*, is sampled at a different location. As a result, the effective axial spatial resolution of the image will be better than the actual axial spatial resolution $R^V$ of each individual projected image 421*a*, 421*b*, 421*c*. The relatively superior effective axial spatial resolution is produced by virtue of the fact that the duplicated measurements from each of the different horizontal slits 430*a*, 430*b*, 430*c*, do not have exact same sampling points thereby resulting in equivalent finer sampling in the axial direction. Hence the skew slit collimator 416 of FIG. 4 provides images with relatively superior effective axial spatial resolution when compared to images generated by the skew slit collimator 216 shown in FIG. 2.

As mentioned previously, in one embodiment, the gamma ray imaging devices 108 are rotated or indexed about the subject 110 in a circular orbit. The use of a circular orbit can contribute to circular orbit related data insufficiency artifacts. The use of a skew slit collimator 416 having a second collimator blade 426 having multiple horizontal slits 430*a*, 430*b*, 430*c*, reduces data insufficiency artifacts caused by the use of a circular orbit.

Sensitivity is typically measured by the total number of photons that pass through the skew slit collimator 416 and can be approximated by the total area covered by the images projected 421*a*, 421*b*, 421*c* onto the detector surface 120 at one time. The use of multiple horizontal slits 430*a*, 430*b*, 430*c*, with appropriate spacing distances between adjacent horizontal slits 430*a*, 430*b*, 430*c*, generates multiple projected images 421*a*, 421*b*, 421*c*, onto the detector surface 120.

When projected images overlap on the detector surface 120 as a result of multiplexing, the information content in the projected image is reduced. Reduced information content leads to relatively ill conditioned image reconstruction and greater sensitivity to noise amplification. More specifically, reduced location information resulting from projected image overlap increases the severity of artifact and decreases image resolution. The use of a second collimator blade having too many horizontal slits, or having horizontal slits that are too closely spaced together may cause the overlapping of projected images on the detector surface 120.

In one embodiment, the user derives a value for adjacent horizontal slit spacing by: approximating the size of the region of interest within the subject 110, such as for example, the size of the target organ; determining the axial amplification factor for the skew slit collimator 416; and multiplying the approximated size of the region of interest by the axial amplification factor. However, it should be noted that while one method of determining a value for adjacent horizontal slit spacing has been described, alternative methods of selecting a value for adjacent horizontal slit spacing are also considered to be within the scope of the invention.

The regular and separated positioning of projected images on the detector surface 120 also facilitates the development of analytical reconstruction algorithms.

Figure 5:
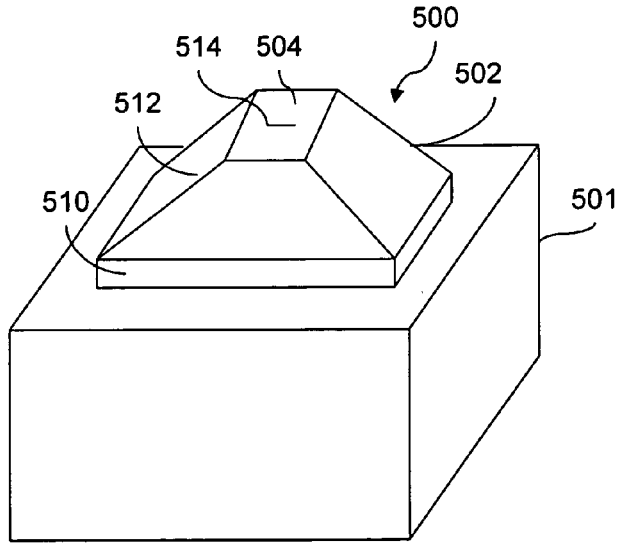
FIG. 5 is a perspective view of one embodiment of a skew slit collimator assembly in accordance with the principles of the present invention.
Figure 6:
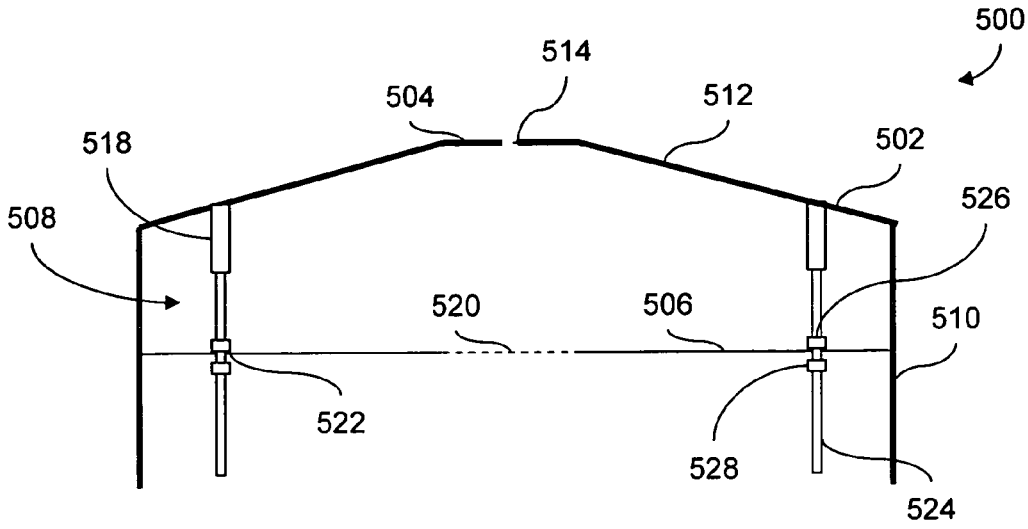
FIG. 6 is a side cross-sectional view of the skew slit collimator assembly of FIG. 5.

Referring to FIG. 5 and FIG. 6 a perspective view and a cross-sectional side view of one embodiment of a skew slit collimator assembly 500 is shown. The skew slit collimator assembly 500 is removeably mounted onto a detector housing 501. The skew slit collimator assembly 500 generally includes a collimator housing 502 having an integrated first collimator blade 504, a second collimator blade 506, and a blade positioning mechanism 508.

The collimator housing 502 generally includes four sidewalls 510, four angled walls 512 that extend upward and inward from each of the four sidewalls 510 and an upper wall 504. The upper wall 504 operates as the first collimator blade 504 and includes a first slit 514. A pair of fastening posts 518 extend downwardly from each of the two opposing angled walls 512. The collimator housing 502 is manufactured from a gamma ray shielding material, such as for example, lead, tungsten, gold, iridium or platinum. While a number of materials that can be used to manufacture collimator housings have been described, collimator housings manufactured from other gamma ray shielding materials are also considered to be within the scope of the invention.

The second collimator blade 506 includes a second slit 520 and four positioning holes 522. The positioning holes 522 are aligned with the positions of the fastening posts 518. The second collimator blade 506 is manufactured from a gamma ray shielding material, such as for example, lead, tungsten, gold, iridium or platinum. While a number of materials that can be used to manufacture second collimator blades 506 have been described, second collimator blades 506 manufactured from other gamma ray shielding materials are also considered to be within the scope of the invention.

Based on selected values for $F_1$, $F_2$, and $D_2$, the user can derive a distance for positioning the second collimator blade 506 with respect to the upper wall 504 (acting as a first collimator blade). The distance $D_1$ between the upper wall 504 and the detector surface 120 is fixed. The blade positioning mechanism 508 is used to position the second collimator blade 506 at the selected distance $D_2$ from the detector surface 120 and at the derived distance from the upper wall 504. The blade positioning mechanism 508 generally includes the four fastening posts 518, four threaded posts 524, four upper positioning nuts 526 and four lower positioning nuts 528.

To assemble the skew slit collimator assembly 500, one end of each of the four threaded posts 524 is threaded into each of the four fastening posts 518. The four upper positioning nuts 526 are threaded onto the four threaded posts 524 such that the lower edge of each of the upper positioning nuts 526 is approximately at the user derived distance from the upper wall 504. The second collimator blade 506 is oriented with respect to the upper wall 504, such that the lengthwise orientation of the second slit 520 is generally orthogonal to the lengthwise orientation of the first slit 514. The positioning holes 522 of the second collimator blade 506 are aligned with the four threaded posts 524 and the second collimator blade 506 is positioned against the four upper positioning nuts 526. The four lower positioning nuts 528 are threaded onto the four threaded posts 524 to secure the second collimator blade 506 against the four upper positioning nuts 526.

The user has the option of mounting the configured skew slit assembly 500 onto the detector 118 in either a first configuration as illustrated in FIG. 2 or a second configuration as illustrated in FIG. 3. In the first configuration, the first slit 514 is oriented as a vertical slit where the lengthwise orientation of the first slit 514 is positioned generally parallel to the axis of rotation 122. In the second configuration, the first slit 514 is oriented as a horizontal slit where the lengthwise orientation of the first slit 514 is positioned generally orthogonal to the axis of rotation 122. The configured skew slit collimator assembly 500 is mounted onto the detector 118 in one of the two described configurations using any one of a number of techniques for mounting collimators onto the detectors 118 that are generally known to one of ordinary skill in the art.

In another embodiment of the skew slit collimator assembly 500, the second collimator blade 506 has two or more parallel slits. The skew slit collimator configuration for such a skew slit collimator 416 including a second collimator blade 506 having multiple slits is illustrated in FIG. 4. The second collimator blade 506 is oriented with respect to the upper wall 504, such that the lengthwise orientation of the multiple parallel slits are generally orthogonal to the lengthwise orientation of the first slit 514.

In one embodiment, the second collimator blade 506 has a slit width adjustment mechanism (described below). In another embodiment of the skew slit collimator assembly 500, a set of second collimator blades where each second collimator blade has a different second slit width is provided. In yet another embodiment, a set of second collimator blades having multiple parallel slits is provided where each second collimator blade has a different number of slits. In yet another embodiment, a set of second collimator blades having multiple slits is provided where the width of the multiple slits vary from second collimator blade to second collimator blade. In another embodiment, a second collimator blade having multiple slits include a slit width adjustment mechanism for adjusting the width of each of the multiple slits (described below).

It should be noted that while one manner of securing a second collimator blade to the collimator housing has been described, alternative mechanisms for securing the second collimator blade to the collimator housing are also considered to be within the scope of the invention.

Figure 7:
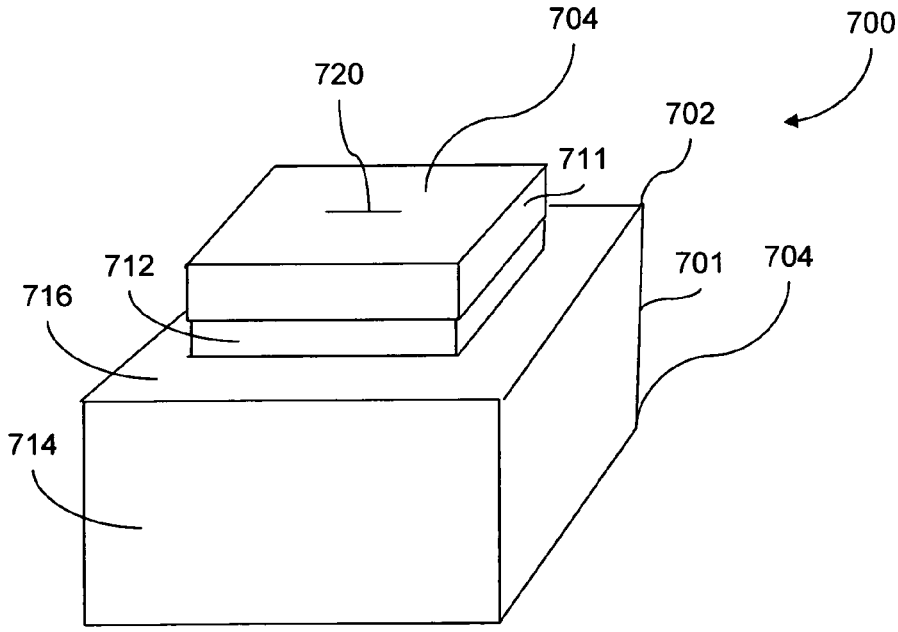
FIG. 7 is a perspective view of another embodiment of a skew slit collimator assembly in accordance with the principles of the present invention.

Referring to FIG. 7 and FIG. 8 a perspective view and a cross-sectional side view of another embodiment of a skew slit collimator assembly 700 is shown. The skew slit collimator assembly 700 is removeably mountable onto a detector 118. The skew slit collimator assembly 700 generally includes a collimator housing 702, a first collimator blade 704, a second collimator blade 706, a first blade positioning mechanism 708 and a second blade positioning mechanism 710.

The collimator housing 702 shields the detector 118 from stray gamma rays. The collimator housing 702 generally includes an upper frame 711, a lower frame 712, four lower sidewalls 714 and an upper ledge 716. The upper ledge 716 extends inwardly from the upper edges of the lower sidewalls 714 to the lower edges of the lower frame 712. The combined upper frame 711 and lower frame 712 define four upper sidewalls. The upper frame 711 is slidably fitted over the lower frame 712 such that the total height of the upper sidewalls can be adjusted by adjusting the position of the upper frame 711 with respect to the lower frame 712. Four fastening posts 718 extend downward from the lower surface of the upper ledge 716. The collimator housing 702 is manufactured from a gamma ray shielding material, such as for example, lead, tungsten, gold, iridium or platinum. While a number of materials that can be used to manufacture collimator housings have been described, collimator housings manufactured from other gamma ray shielding materials are also considered to be within the scope of the invention.

The first collimator blade 704 includes a first slit 720 and a set of four positioning holes 722. The second collimator blade 706 includes a second slit 724, four inner positioning holes 726, and four outer positioning holes 728. The four inner positioning holes 726 are aligned with the four positioning holes 722 of the first collimator blade 704. The four outer positioning holes 728 are aligned with the four fastening posts 718. The first and second collimator blades 704, 706, are manufactured from a gamma ray shielding material, such as for example, lead, tungsten, gold, iridium or platinum. While a number of materials that can be used to manufacture the first and second collimator blades 704, 706, have been described, first and second collimator blades manufactured from other gamma ray shielding materials are also considered to be within the scope of the invention.

The first blade positioning mechanism 708 is used to position the second collimator blade 706 at a selected distance from the first collimator blade 704. The first blade positioning mechanism 708 generally includes four threaded bolts 730, four upper positioning nuts 732 and eight lower positioning nuts 734.

The second blade positioning mechanism 710 is used to position the second collimator blade 706 at a selected distance $D_2$ from the detector surface 120. The second blade positioning mechanism 710 includes four fastening posts 718, four threaded posts 736, four upper positioning nuts 738 and four lower positioning nuts 740.

To assemble the skew slit collimator assembly 700, each of the four threaded bolts 730 is inserted into a positioning hole 722 in the first collimator blade 704. Four lower positioning nuts 734 are threaded onto each of the four threaded bolts 730 to secure the first collimator blade 704.

Based on selected values for $F_1$, $F_2$, $D_1$, and $D_2$, the user derives a distance for positioning the second collimator blade 706 with respect to the first collimator blade 704. Four upper positioning nuts 732 are threaded onto the four threaded bolts 730 such that the lower edge of each upper positioning nut 732 is approximately at the user derived distance from the first collimator blade 704. The second collimator blade 706 is oriented with respect to the first collimator blade 704, such that the lengthwise orientation of the second slit 724 is generally orthogonal to the lengthwise orientation of the first slit 720. The inner positioning holes 726 of the second collimator blade 706 are aligned with the four threaded bolts 730 and the second collimator blade 706 is positioned against the four upper positioning nuts 732. Four lower positioning nuts 734 are threaded onto the four threaded bolts 730 to secure the second collimator blade 706 in place.

The upper frame 711 is slidingly adjusted with respect to the lower frame 712 such that the sum of the heights of the upper sidewall and lower sidewall 714 approximates the selected distance $D_1$. The upper edges of the upper frame 711 are generally flush with the planar surface of the first collimator blade 704. Once the adjustments are complete, the upper frame 711 is secured to the lower frame 712 using any one of a number of fastening mechanisms that are known to one of ordinary skill in the art.

The second blade positioning mechanism is used to secure the assembled first and second collimator blades 704, 706 to the collimator housing 702 such that the second collimator blade 706 is positioned at a distance $D_2$ from the detector surface 120. One end of each of the four threaded posts 736 is threaded into each of the four fastening posts 718. The four upper positioning nuts 738 are threaded onto the four threaded posts 736 such that the lower edge of the upper positioning nuts 738 are approximately positioned at a distance $D_2$ from the detector surface 118. With the first collimator blade 704 facing outward, the assembled first and second collimator blades 704, 706 is inserted into the collimator housing 702, such that the threaded posts 736 extend through the outer positioning holes 728 of the second collimator blade 706. The second collimator blade 706 is positioned against the four upper positioning nuts 738. The four lower positioning nuts 740 are threaded onto the four threaded posts 736 to secure the second collimator blade 706 against the four upper positioning nuts 738.

The user has the option of mounting the skew slit assembly 700 onto the detector 118 in either a first configuration as illustrated in FIG. 2 or a second configuration as illustrated in FIG. 3. In the first configuration, the first slit 720 is oriented as a vertical slit where the lengthwise orientation of the first slit 720 is positioned generally parallel to the axis of rotation 122. In the second configuration, the first slit 720 is oriented as a horizontal slit where the lengthwise orientation of the first slit 720 is positioned generally orthogonal to the axis of rotation 122. The skew slit collimator assembly 700 is mounted onto the detector 118 in one of the two described configurations using any one of a number of techniques for mounting collimators onto detectors that are generally known to one of ordinary skill in the art.

In another embodiment of the skew slit collimator assembly 700, the second collimator blade 706 has two or more parallel slits. The skew slit collimator configuration a skew slit collimator including a second collimator blade 706 having multiple slits is illustrated in FIG. 4. The second collimator blade 706 is oriented with respect to the first collimator blade 704, such that the lengthwise orientation of the multiple parallel slits are generally orthogonal to the lengthwise orientation of the first slit 720.

In one embodiment, the first and second collimator blades each have a slit width adjustment mechanism (described below). In another embodiment of the skew slit collimator assembly 700, a set of first collimator blades where each first collimator blade has a different first slit width $d_1$ and a set of second collimator blades where each second collimator blade has a different second slit width $d_2$ is provided. In yet another embodiment, a set of second collimator blades having multiple parallel slits is provided where each second collimator blade has a different number of slits. In yet another embodiment, a set of second collimator blades having multiple slits is provided where the width of the multiple slits vary from second collimator blade to second collimator blade. In another embodiment, a set of second collimator blades having multiple slits is provided where the spacing between adjacent slits varies from blade to blade. In another embodiment, a second collimator blade having multiple slits includes a slit width adjustment mechanism for adjusting the width of each of the multiple slits (described below).

Furthermore, it should be noted that while one manner of securing the first and second collimator blade to the collimator housing has been described, alternative mechanisms for securing the first and second collimator blades to the collimator housing are also considered to be within the scope of the invention.

Referring to FIG. 9-FIG. 11, a collimator blade 900 having an slit width adjustment mechanism in accordance with the principles of the present invention generally includes a base blade 904, first and second slit blades 906, 908, and a securing mechanism 910. The base blade 904 includes a slit width aperture 912. The securing mechanism 910 consists of a plurality of positioning slots 914 and a plurality of nuts and bolts 916. The base blade 904 and the first and second slit blades 906, 908, each include positioning slots 914. The first and second slit blades 906, 908, are positioned on top of the base blade 904 such that a slit 918 having a selected slit width is defined therebetween. The first and second slit blades 906, 908, are secured in place to the base blade 904 using the securing mechanism 910.

In another embodiment, the collimator blade is a multiple slit collimator blade. The multiple slit collimator blade includes a base blade having multiple generally parallel slit width apertures, where each slit width aperture is operable to be configured as a single slit. A set of first and second slit blades and associated securing mechanisms are provided for each of slit width apertures. Each individual slit width can be adjusted and secured as described above.

The base blade 904 is manufactured from a gamma ray shielding material, such as for example, lead, tungsten, gold, iridium or platinum. The first and second slit blades 906, 908 are manufactured from a gamma ray shielding material, such as for example, lead, tungsten, gold, iridium or platinum. While a number of materials that can be used to manufacture the base blade 904 and first and second slit blades have been described, base blades and first and second slit blades 906, 908, manufactured from other gamma ray shielding materials are also considered to be within the scope of the invention.

While the embodiments of the invention disclosed herein are presently considered to be preferred, various changes, and modifications can be made without departing from the spirit and scope of the invention. The scope of the invention is indicated in the appended claims, and all changes that come within the meaning and range of equivalents are intended to be embraced therein.

What is claimed is:

1. A skew slit collimator for a gamma ray imaging device including a detector having a generally planar detector surface, the detector surface operable to be positioned adjacent a subject imaging region, the skew slit collimator comprising:

a first collimator blade having a first slit, the first collimator blade being generally parallel to a detector surface and disposed in front of the detector surface, wherein the first collimator blade is operable to be positioned at a first focal length from an axis of rotation; and a second collimator blade having a second slit, a lengthwise orientation of the second slit being generally orthogonal to a lengthwise orientation of the first slit, the second collimator blade being generally parallel to the first collimator blade and disposed between the first collimator blade and the detector surface such that the second collimator blade is spaced apart from the first collimator blade and positioning the first collimator blade at the first focal length from the axis of rotation operates to position the second collimator blade at a second focal length from the axis of rotation, the second focal length being greater than the first focal length.

2. The skew slit collimator of claim 1, wherein the lengthwise orientation of the first slit is generally parallel to the axis of rotation, the axis of rotation being defined by a direction of rotation of a gamma ray imaging device around a subject imaging region.

3. The skew slit collimator of claim 1, wherein the lengthwise orientation of the first slit is generally parallel to the axis of rotation, the axis of rotation being defined by a direction of rotation of a rotatable subject support in a subject imaging region.

4. The skew slit collimator of claim 1, wherein the lengthwise orientation of the first slit is generally orthogonal to the axis of rotation, the axis of rotation being defined by a direction of rotation of a gamma ray imaging device around a subject imaging region.

5. The skew slit collimator of claim 1, wherein the lengthwise orientation of the first slit is generally orthogonal to the axis of rotation, the axis of rotation being defined by a direction of rotation of a rotatable subject support in a subject imaging region.

6. The skew slit collimator of claim 1, wherein the first collimator blade is manufactured from a material selected from a group consisting of tungsten, lead, gold, iridium, and platinum.

7. The skew slit collimator of claim 1, wherein the second collimator blade is manufactured from a material selected from a group consisting of tungsten, lead, gold, iridium, and platinum.

8. The skew slit collimator of claim 1, wherein the first collimator blade includes a slit width adjustment mechanism.

9. The skew slit collimator of claim 1, wherein the second collimator blade includes a slit width adjustment mechanism.

10. A skew slit collimator for a gamma ray imaging device including a detector having a generally planar detector surface, the detector surface operable to be positioned adjacent a subject imaging region, the skew slit collimator comprising:

a first collimator blade having a first slit, the first collimator blade being generally parallel to a detector surface and disposed in front of the detector surface; and a second collimator blade having a second slit and a third slit spaced apart from the second slit, a lengthwise orientation of the second slit being generally orthogonal to a lengthwise orientation of the first slit and a lengthwise orientation of the third slit being generally parallel to the lengthwise orientation of the second slit, the second collimator blade being generally parallel to the first collimator blade and disposed between the first collimator blade and the detector surface such that the second collimator blade is spaced apart from the first collimator blade.

11. A skew slit collimator for a gamma ray imaging device including a detector having a generally planar detector surface, the detector surface operable to be positioned adjacent a subject imaging region, the skew slit collimator comprising:

a first collimator blade having a first slit, the first collimator blade being generally parallel to a detector surface and disposed in front of the detector surface;

a second collimator blade having a second slit, a lengthwise orientation of the second slit being generally orthogonal to a lengthwise orientation of the first slit, the second collimator blade being generally parallel to the first collimator blade and disposed between the first collimator blade and the detector surface such that the second collimator blade is spaced apart from the first collimator blade; and a first blade positioning mechanism operable to selectively position the first collimator blade at a first distance from the detector surface.

12. A skew slit collimator for a gamma ray imaging device including a detector having a generally planar detector surface, the detector surface operable to be positioned adjacent a subject imaging region, the skew slit collimator comprising:

a first collimator blade having a first slit, the first collimator blade being generally parallel to a detector surface and disposed in front of the detector surface;

a second collimator blade having a second slit, a lengthwise orientation of the second slit being generally orthogonal to a lengthwise orientation of the first slit, the second collimator blade being generally parallel to the first collimator blade and disposed between the first collimator blade and the detector surface such that the second collimator blade is spaced apart from the first collimator blade; and a second blade positioning mechanism operable to selectively position the second collimator blade at a second distance from the detector surface.

13. A method of configuring a skew slit collimator for a gamma ray imaging device including a detector having a generally planar detector surface, the detector surface operable to be positioned adjacent a subject imaging region, the method comprising:

positioning a first collimator blade having a first slit in front of and generally parallel to a detector surface the first collimator blade being operable to be positioned at a first focal length from an axis of rotation;

orienting a second collimator blade having a second slit such that the second collimator blade is generally parallel to the first collimator blade and a lengthwise orientation of the second slit is generally orthogonal to a lengthwise orientation of the first slit; and positioning the second collimator blade between the first collimator blade and the detector surface such that the second collimator blade is spaced apart from the first collimator blade and positioning the first collimator blade at the first focal length from the axis of rotation operates to position the second collimator at a second focal length from the axis of rotation, the second focal length being greater than the first focal length.

14. The method of claim 13, further comprising:

determining the axis of rotation; and positioning the lengthwise orientation of the first slit generally parallel to the determined axis of rotation.

15. The method of claim 14, further comprising:

selecting a transaxial spatial resolution for a projected image of a subject to be positioned within the subject imaging region for imaging; and selecting a first slit width for the first slit based on the selected transaxial spatial resolution.

16. The method of claim 14, further comprising:

selecting an axial spatial resolution for a projected image of a subject to be positioned within the subject imaging region for imaging; and selecting a second slit width for the second slit based on the selected axial spatial resolution.

17. The method of claim 13, further comprising:

determining the axis of rotation; and positioning the lengthwise orientation of the first slit generally orthogonal to the determined axis of rotation.

18. The method of claim 13, further comprising adjusting a width of the first slit.

19. The method of claim 13, further comprising adjusting a width of the second slit.

20. The method of claim 13, further comprising:

determining the axis of rotation;

selecting a first amplification factor in a first direction that is generally orthogonal to the axis of rotation;

selecting a second amplification factor in a second direction that is generally parallel to the axis of rotation;

if the first amplification factor is greater than the second amplification factor, positioning the first collimator blade such that the lengthwise orientation of the first slit is generally parallel to the axis of rotation; and if the second amplification factor is greater than the first amplification factor, positioning the first collimator blade such that the lengthwise orientation of the first slit is generally orthogonal to the axis of rotation.

21. A method of configuring a skew slit collimator for a gamma ray imaging device including a detector having a generally planar detector surface, the detector surface operable to be positioned adjacent a subject imaging region, the method comprising:

positioning a first collimator blade having a first slit in front of and generally parallel to a detector surface;

orienting a second collimator blade having a second slit and a third slit at a spaced apart distance from the second slit, the third slit having a lengthwise orientation generally parallel to the second slit, such that the second collimator blade is generally parallel to the first collimator blade and a lengthwise orientation of the second slit is generally orthogonal to a lengthwise orientation of the first slit; and positioning the second collimator blade between the first collimator blade and the detector surface such that the second collimator blade is spaced apart from the first collimator blade.

22. The method of claim 21, further comprising:

determining an approximate size of a target organ within a subject to be positioned within the subject imaging region for imaging;

determining an axial amplification factor of a projected image of the subject on the detector surface; and deriving the spaced apart distance between the second slit and the third slit, the spaced apart distance being a product of the determined approximate size of the target organ and the determined axial amplification factor.

23. A method of configuring a skew slit collimator for a gamma ray imaging device including a detector having a generally planar detector surface, the detector surface operable to be positioned adjacent a subject imaging region, the method comprising:

positioning a first collimator blade having a first slit in front of and generally parallel to a detector surface;

orienting a second collimator blade having a second slit such that the second collimator blade is generally parallel to the first collimator blade and a lengthwise orientation of the second slit is generally orthogonal to a lengthwise orientation of the first slit;

positioning the second collimator blade between the first collimator blade and the detector surface such that the second collimator blade is spaced apart from the first collimator blade;

determining an axis of rotation;

selecting an axial amplification factor for a projected image of the subject; and determining a focal length based on the selected axial amplification factor, the focal length being the distance between the second collimator blade and the axis of rotation.

24. The method of claim 23, wherein selecting an axial amplification factor further comprises selecting an axial amplification factor of less than two.

* * * * *